US011732575B2

(12) United States Patent
Horning, Jr. et al.

(10) Patent No.: US 11,732,575 B2
(45) Date of Patent: Aug. 22, 2023

(54) OIL WELL ORPHAN WELL CASING LOCATOR AND A LOCATOR SYSTEM THEREFOR

(71) Applicants: Ronald Horning, Jr., Mt. Pleasant, MI (US); Brian Wright, Mt. Pleasant, MI (US)

(72) Inventors: Ronald Horning, Jr., Mt. Pleasant, MI (US); Brian Wright, Mt. Pleasant, MI (US)

( * ) Notice: Subject to any disclaimer, the term of this patent is extended or adjusted under 35 U.S.C. 154(b) by 0 days.

(21) Appl. No.: 17/645,775

(22) Filed: Dec. 23, 2021

(65) Prior Publication Data

US 2023/0203940 A1 Jun. 29, 2023

(51) Int. Cl.
*E21B 47/09* (2012.01)
*E21B 47/12* (2012.01)

(52) U.S. Cl.
CPC ..... *E21B 47/09* (2013.01); *E21B 47/12* (2013.01)

(58) Field of Classification Search
CPC ..... E21B 47/09; E21B 47/092; E21B 47/12
See application file for complete search history.

(56) References Cited

U.S. PATENT DOCUMENTS

| | | | | |
|---|---|---|---|---|
| 4,219,773 | A | 8/1980 | Markfelt | |
| 6,459,383 | B1 * | 10/2002 | Delatorre | G01V 11/00 166/250.11 |
| 6,815,946 | B2 | 11/2004 | Yoo | |
| 7,347,261 | B2 | 3/2008 | Markel et al. | |
| 8,103,135 | B2 | 1/2012 | Head | |
| 8,225,869 | B2 | 7/2012 | Beard et al. | |
| 8,316,937 | B2 | 11/2012 | Cronley et al. | |
| 8,645,571 | B2 | 2/2014 | Downton et al. | |
| 10,400,544 | B2 | 9/2019 | Stokley et al. | |
| 10,677,820 | B2 | 6/2020 | Olsson et al. | |
| 10,900,351 | B2 | 1/2021 | Deffenbaugh et al. | |
| 2018/0329105 | A1 * | 11/2018 | Capoglu | G01V 3/18 |
| 2022/0179120 | A1 * | 6/2022 | Zheng | E21B 19/165 |

* cited by examiner

*Primary Examiner* — Robert E Fuller
*Assistant Examiner* — Lamia Quaim

(57) ABSTRACT

An oil well orphan well casing locator primarily used for locating abandoned well heads below ground.

2 Claims, 3 Drawing Sheets

OIL WELL ORPHAN WELL CASING LOCATOR AND A LOCATOR SYSTEM THEREFOR

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

This invention deals with an oil well orphan well casing locator primarily used for locating abandoned well heads below ground.

Several approaches have been published regarding the use of various instruments for locating. For example, U.S. Pat. No. 4,219,773 that issued Aug. 26, 1980, to Markfelt deals with an instrument for locating the depth of the lower end of a mild steel or cast iron well casing using magnets encapsulated in an instrument.

U.S. Pat. No. 6,815,946 that issued on Nov. 9, 2004, to Yoo deals with a magnetically activated well tool i.e., a magnetoresistive sensor for detecting anomalies in the wall of a casing string disposed in a well bore.

U.S. Pat. No. 7,347,261 that issued to Markel et al., on Mar. 25, 2008, deals with a magnetic locator system that includes a magnetic field generator attached to an oilfield tool component.

U.S. Pat. No. 8,103,135 that issued on Jan. 24, 2012, to Head deals with a well bore sensing system using fiber-optic cable.

In addition, U.S. Pat. No. 8,225,869 that issued Jul. 24, 2012, to Beard et al., deals with devices for determining depths of certain structures in a downhole string using locator springs longitudinally mounted on a shaft.

U.S. Pat. No. 8,316,937 that issued Nov. 27, 2012, to Cronley et al., deals with a lateral well locator/reentry apparatus and method for down-hole use.

U.S. Pat. No. 8,645,571 that issued Feb. 4, 2014, to Downton et al., deals with a system for managing using data for tools in a well bore using a wireless network.

A system including a cementing tool positionable within a casing string of a well bore using fiber optics is disclosed in U.S. Pat. No. 10,400,544, that issued Sep. 3, 2019, to Stokley, et al., A voluminous U.S. Pat. No. 10,677,820 that issued Jun. 9, 2020, to Olsson, et al., deals with buried locators for finding and mapping buried objects such as utilities, using intuitive graphical user interface display.

U.S. Pat. No. 10,900,351 that issued Jan. 26, 2021, to Deffenbaugh et al., deals with a device for obtaining measurements of downhole properties in a subterranean well using sensors.

None of these publications describe or make obvious the device of the instant invention.

BRIEF SUMMARY OF THE INVENTION

This invention deals with an oil well orphan well casing locator primarily used for locating abandoned well heads below ground.

Thus, this invention deals with an oil well orphan well casing locator. The oil well orphan well casing locator comprises a hollow elongated housing having a top, a bottom and a side opening.

The housing has contained therein an inductive proximity sensor mounted interior to the elongated housing with the sensor inserted in a side opening to provide a single sensing direction.

The device also includes electronics for controlling the inductive proximity sensor wherein the top of the elongated housing has fixed to it an interiorly threaded female connector. The bottom of the elongated housing has an externally threaded male connector attach to it.

In another embodiment, there is an oil well orphan well casing locator system. The oil well orphan well casing locator system comprises in combination an oil well orphan well casing locator as describe just Supra; a pulse control circuit; a microprocessor; a line driver circuit; recorder and display for recording and displaying signals.

BRIEF DESCRIPTION OF THE SEVERAL VIEW OF THE DRAWING

DETAILED DESCRIPTION OF THE DRAWINGS

An orphan well is an oil or gas well, which has not been properly plugged according to the requirement of State law. These wells are often buried far below the surface and not marked very well. Reentry is required to properly seal them off.

Once an abandon/orphan well is chosen to be located and fixed, the first step is to attempt to drill into the old casing for purposes of locating the well. It is often difficult because of the depth and lack of markings for the exact location.

After the driller suspects that they have found the old well, usually because of new metal shavings returning to the surface, the device of this invention is used to verify they are in the well and not just next to it. This is accomplished by inserting the device of this invention in the well head. The device has a focus of a single direction and once in the drill hole, is turned 360°. If metal in not detected around the entire 360° then the device is not in the interior of the wellhead but is alongside of the well head. This also gives the driller an indication of what direction they need to move to enter the old well. When the sensor shows that the entire 360° turn detects metal, then it is confirmed that the device is in the interior of the well head. A small power supply is used to power the sensor, pulse control circuitry and a line driver. The device of this invention uses an inductive proximity sensor perpendicular to the bore hole to detect metal in the bore hole walls. The signal from the sensor is fed into a microprocessor in the pulse control circuit. The microprocessor determines what pulses to send up hole. The pulses are then sent to a line drive circuit and fed back into a wireline or down hole telemetry to be sent up hole, for recoding and display.

DETAILED DESCRIPTION OF THE INVENTION

Figure 1:
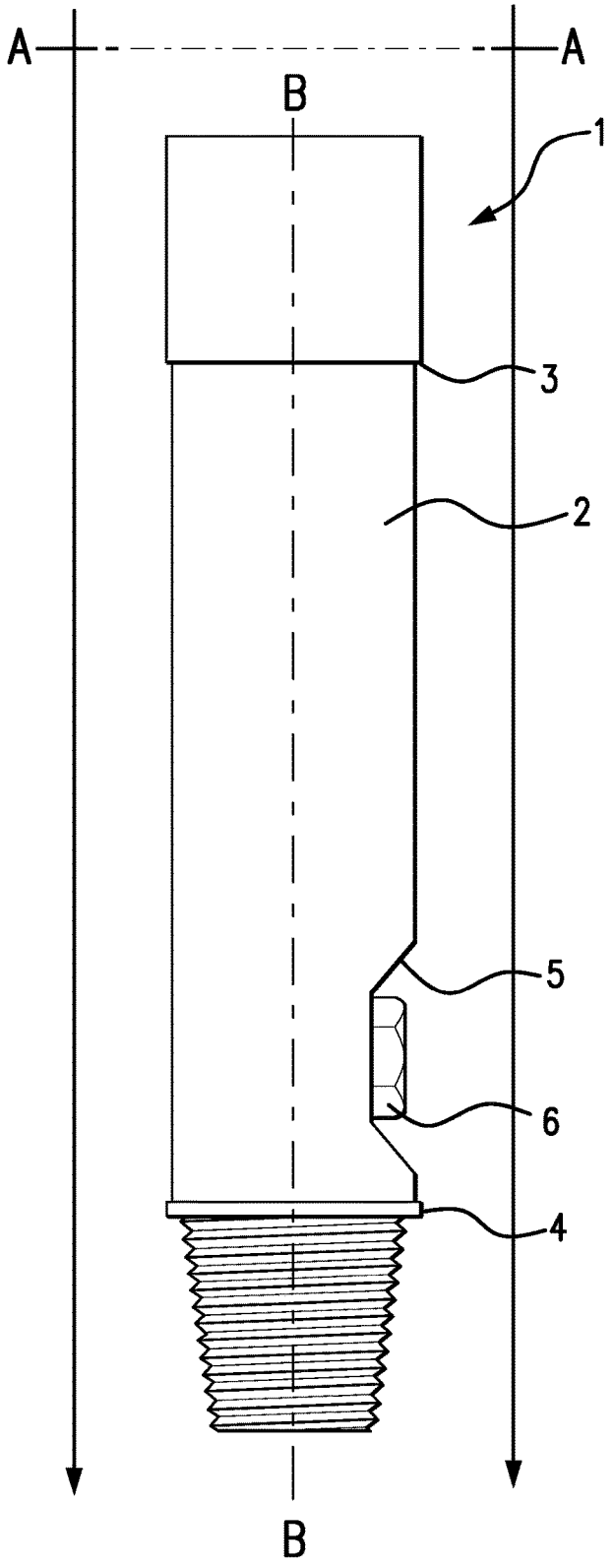
FIG. 1 is a full side view of a device of this invention.

Turning now to the drawings and with regard to FIG. 1, there is shown a full side view of a device 1 of this invention. There is shown a housing 2 which is elongated and has a longitudinal axis, and it has a top 3, a bottom 4, and a single side opening 5. This housing 1 is a pump through housing, meaning it is hollow through its entire interior.

Figure 2:
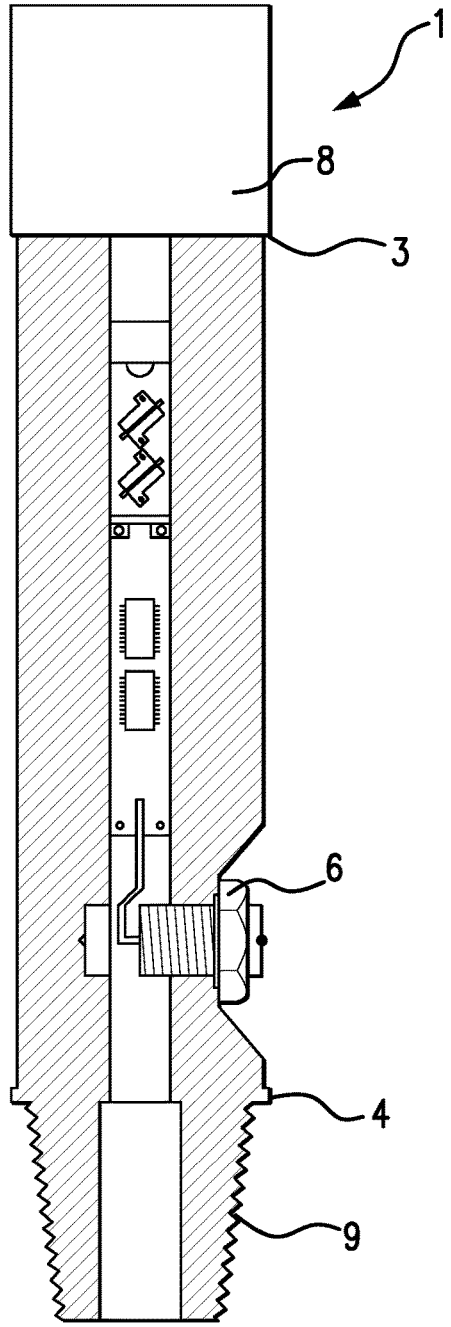
FIG. 2 is a cross sectional view of the device of Figure through line A-A.

Turning to FIG. 2, there is shown contained in the housing 1 an inductive proximity sensor 6 mounted near the bottom 4 and perpendicular to the long axis (FIG. 1, line B-B) of the device.

It should be noted that the inductive proximity sensor 6 has a single focus i.e., a single sensing direction.

Near the middle of the housing 1 is an electronics system 7 for controlling the inductive proximity sensor 6. At the top 3, there is located an interiorly threaded female connector 8 which allows connection to a drop line (not shown and not part of the device invention) and located at the bottom 4 is an externally threaded male connector 9. What is not shown is the necessary cables, etc., that are used to transmit signals to data controllers.

Figure 3:
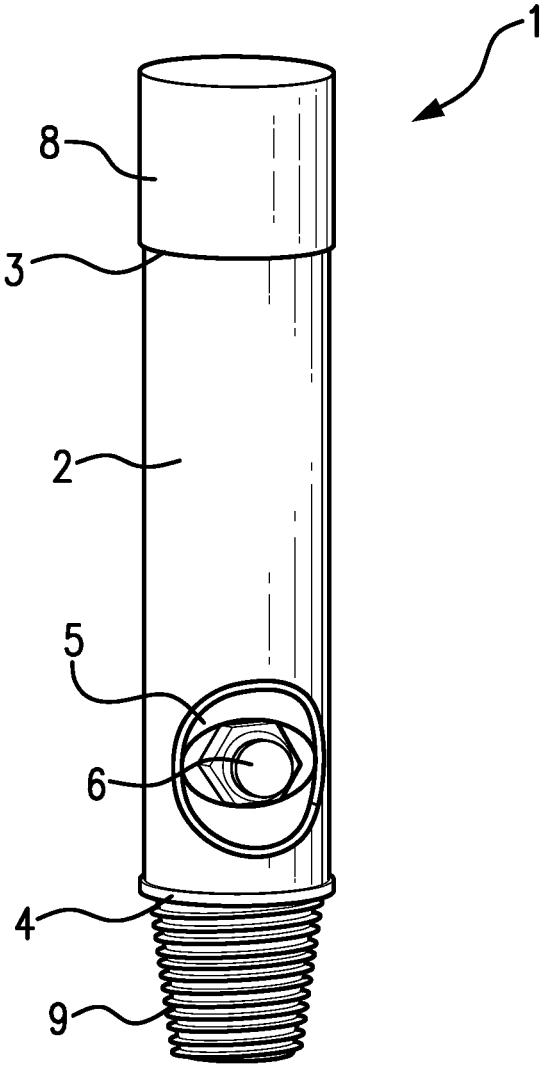
FIG. 3 is a full front view of a device of this invention.

FIG. 3 is a full front view of the device 1 of this invention.

Figure 4:
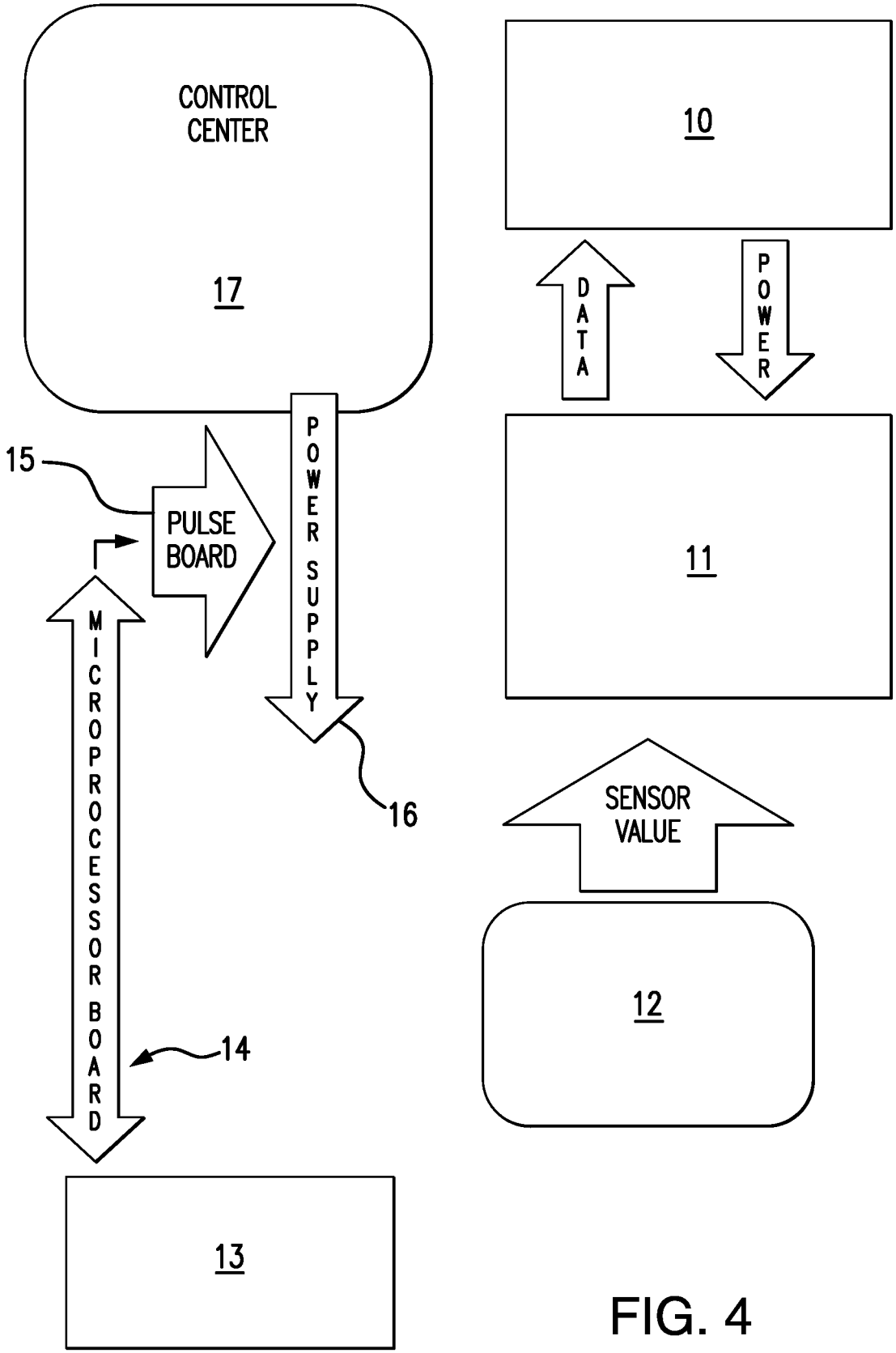
FIG. 4 is a schematic of one assembly for use of the device of this invention.

Another embodiment of this invention is a system using the device 1. The system Shown in the schematic of FIG. 4 comprises the device 1 which is connected electronically to a pulse control circuit, a microprocessor, a line driver circuit, and a recorder and display for recording and displaying signals.

In the schematic, box 10 is a computer system that sends power to the locator and receives sensor information back from the device 1. Box 11 shows electronics that get power from the up hole computer and sensor value from the sensor which converts sensor values into a format that the computer can understand such as pulses or digital data, then it sends the data up hole on a wireline.

Box 12 shows the sensor sending values to the electronics depending on the proximity of the metal to the sensor. Box 13 is the device 1 (sensor). Box 14 is a microprocessor board and 15 is a pulse board. Box 16 is the power supply to the sensor and the microprocessor board. Finally, box 17 is the control center for all of the assembly.

The method by which the data gets up hole and the method by which the tool is powered can be changed to suit the situation and the needs for the tool. For example, the tool can be powered with batteries down hole and can then send mud pulse information when it is in proximity to the metal casing. This doesn't change the function or design of the tool, just the method by which the data gets observed at the surface.

What is claimed is:

1. An oil well orphan well casing locator, said oil well orphan well casing locator comprising:

A) a hollow elongated housing having a top, a bottom and a side through opening, said housing having contained therein, B) an inductive proximity sensor mounted interior to said elongated housing with said sensor inserted in said side through opening to provide a single sensing direction;

C) electronics for controlling said inductive proximity sensor;

D) said top of said elongated housing having fixed thereto an interiorly threaded female connector;

E) said bottom of said elongated housing having an externally threaded male connector attached thereto.

2. An oil well orphan well casing locator system, said oil well orphan well casing locator system comprising in combination:

A) an oil well orphan well casing locator as claimed in claim 1;

B) a pulse control circuit;

C) a microprocessor;

D) a line driver circuit;

E) recorder and display for recording and displaying signals.

* * * * *